US009100732B1

(12) United States Patent
Dong et al.

(10) Patent No.: US 9,100,732 B1
(45) Date of Patent: Aug. 4, 2015

(54) HERTZIAN DIPOLE HEADPHONE SPEAKER

(71) Applicant: Google Inc., Mountain View, CA (US)

(72) Inventors: Jianchun Dong, Palo Alto, CA (US); Carroll Philip Gossett, Mountain View, CA (US)

(73) Assignee: Google Inc., Mountain View, CA (US)

( * ) Notice: Subject to any disclaimer, the term of this patent is extended or adjusted under 35 U.S.C. 154(b) by 306 days.

(21) Appl. No.: 13/853,197

(22) Filed: Mar. 29, 2013

(51) Int. Cl.
*H04R 1/10* (2006.01)
*H04R 3/00* (2006.01)

(52) U.S. Cl.
CPC ..... *H04R 3/00* (2013.01)

(58) Field of Classification Search
CPC ..... H04R 5/33; H04R 1/1041
USPC ..... 381/74
See application file for complete search history.

(56) References Cited

U.S. PATENT DOCUMENTS

| | | | | |
|---|---|---|---|---|
| 5,953,434 | A | 9/1999 | Boyden | |
| 6,650,758 | B1 | 11/2003 | Van Schyndel | |
| 7,346,315 | B2 | 3/2008 | Zurek et al. | |
| 2004/0136543 | A1 * | 7/2004 | White et al. | 381/74 |
| 2011/0221656 | A1 | 9/2011 | Haddick et al. | |
| 2013/0051585 | A1 * | 2/2013 | Karkkainen et al. | 381/151 |
| 2014/0141724 | A1 * | 5/2014 | Liu et al. | 455/63.1 |

* cited by examiner

*Primary Examiner* — Simon King

(57) ABSTRACT

This disclosure related to an audio unit of a head-mounted apparatus. The head mounted device includes a support structure with at least one side section with least one audio unit. The audio unit is transmits a first signal and a second signal. Either the first signal or the second signal is directed toward an ear of the wearer of the apparatus. The first signal may be an in-phase audio signal and the second signal maybe an out-of-phase audio signal with a 180 degree phase difference. Alternatively, both the first signal and the second signal are in-phase audio signals. The audio unit may operate in one of two modes. The first mode includes the first signal being an in-phase audio signal and the second signal being an out-of-phase audio signal. The second mode includes both the first signal and the second signal being in-phase audio signals.

19 Claims, 11 Drawing Sheets

HERTZIAN DIPOLE HEADPHONE SPEAKER

BACKGROUND

Unless otherwise indicated herein, the materials described in this section are not prior art to the claims in this application and are not admitted to be prior art by inclusion in this section.

Computing devices such as personal computers, laptop computers, tablet computers, cellular phones, and countless types of Internet-capable devices are increasingly prevalent in numerous aspects of modern life. Over time, the manner in which these devices are providing information to users is becoming more intelligent, more efficient, more intuitive, and/or less obtrusive.

The trend toward miniaturization of computing hardware, peripherals, as well as of sensors, detectors, and image and audio processors, among other technologies, has helped open up a field sometimes referred to as "wearable computing." In the area of image and visual processing and production, in particular, it has become possible to consider wearable displays that place a graphic display close enough to a wearer's (or user's) eye(s) such that the displayed image appears as a normal-sized image, such as might be displayed on a traditional image display device. The relevant technology may be referred to as "near-eye displays."

Wearable computing devices with near-eye displays may also be referred to as "head-mountable displays" (HMDs), "head-mounted displays," "head-mounted devices," or "head-mountable devices." A head-mountable display places a graphic display or displays close to one or both eyes of a wearer. To generate the images on a display, a computer processing system may be used. Such displays may occupy a wearer's entire field of view, or only occupy part of wearer's field of view. Further, head-mounted displays may vary in size, taking a smaller form such as a glasses-style display or a larger form such as a helmet, for example.

Emerging and anticipated uses of wearable displays include applications in which users interact in real time with an augmented or virtual reality. Such applications can be mission-critical or safety-critical, such as in a public safety or aviation setting. The applications can also be recreational, such as interactive gaming. Many other applications are also possible.

SUMMARY

In an aspect, this disclosure provides an apparatus. The apparatus may be a head mounted device. The head mounted device includes a support structure having a front section and at least one side section. The side section includes at least one audio unit mounted on the side section. The audio unit is configured to conduct to a first signal and a second audio signal. Either the first audio signal or the second audio signal is directed toward an ear of the wearer of the apparatus.

In some embodiments, the first audio signal is an in-phase audio signal and the second audio signal is an out-of-phase audio signal. The in-phase audio signal and the out-of-phase audio signal from the audio unit form an acoustic dipole by having a 180 degree phase difference. In another embodiment, both the first audio signal and the second audio signal are in-phase audio signals.

The audio unit may be configured to operate in one of two modes. Operating in the first mode includes the first audio signal being an in-phase audio signal and the second audio signal being an out-of-phase audio signal. Operating a second mode includes both the first audio signal and the second audio signal being in-phase audio signals.

In some embodiments, the audio unit includes one audio driver. In other embodiments, the audio unit includes two or more audio drivers. The audio unit may include a cone audio driver, a static audio driver, a balanced armature audio driver, or other audio driver.

In an aspect, this disclosure provides a method. The method includes operating an audio unit in one of two modes. Operating in the first mode includes (i) conducting a first audio signal directed in a first direction with a first phase and (ii) conducting a second audio signal in a second direction with a second phase. The first and second direction are different directions. One of the first direction and the second direction is the direction of a wearer's ear. In some embodiments, the first phase and the second phase have a 180 degree phase difference Operating in the second mode includes (i) conducting the first audio signal directed in a first direction with the first phase and (ii) conducting the second audio signal in a second direction with the first phase, wherein the first and second direction are different directions. In various embodiments, one audio driver provides both the first audio signal and the second audio signal. In other embodiments, a first audio driver provides the first audio signal and a second audio driver provides the second audio signal.

In yet another aspect, this disclosure provides an article of manufacture including a non-transitory computer-readable medium having stored thereon program instructions that, if executed by a processor in a head-worn device, cause the head-worn device to perform operations. The operations include operating a device in one of two modes as previously described.

In a further aspect, this disclosure provides a means for performing a method. The means for performing the method includes means for transmitting audio in one of two modes. The first mode includes (i) means for conducting a first audio signal directed in a first direction with a first phase and (ii) means for conducting a second audio signal in a second direction with a second phase. The first and second direction are different directions. One of the first direction and the second direction is the direction of a wearer's ear. In some embodiments, the first phase and the second phase have a 180 degree phase difference The second mode includes (i) means for conducting the first audio signal directed in a first direction with the first phase and (ii) means for conducting the second audio signal in a second direction with the first phase, wherein the first and second direction are different directions. In various embodiments, the same means provides both the first audio signal and the second audio signal. In other embodiments, a first means provides the first audio signal and a second means provides the second audio signal.

These as well as other aspects, advantages, and alternatives will become apparent to those of ordinary skill in the art by reading the following detailed description, with reference where appropriate to the accompanying drawings.

DETAILED DESCRIPTION

Figure 1A:
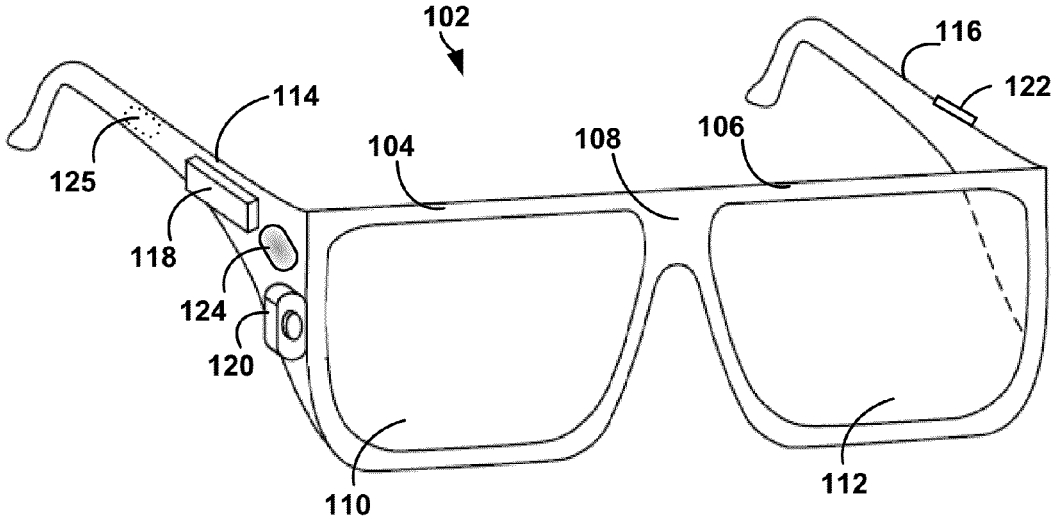
FIG. 1A illustrates a wearable computing system according to an example embodiment.

Example methods and systems are described herein. It should be understood that the words "example" and "exemplary" are used herein to mean "serving as an example, instance, or illustration." Any embodiment or feature described herein as being an "example" or "exemplary" is not necessarily to be construed as preferred or advantageous over other embodiments or features. In the following detailed description, reference is made to the accompanying figures, which form a part thereof. In the figures, similar symbols typically identify similar components, unless context dictates otherwise. Other embodiments may be utilized, and other changes may be made, without departing from the spirit or scope of the subject matter presented herein.

The example embodiments described herein are not meant to be limiting. It will be readily understood that the aspects of the present disclosure, as generally described herein, and illustrated in the figures, can be arranged, substituted, combined, separated, and designed in a wide variety of different configurations, all of which are explicitly contemplated herein.

When wearing an HMD, it may be desirable for a wearer to not have his or her ears blocked. If an HMD has speakers or earbuds that are inserted in a wearers ears, the wearer may not be able to as easily hear his or her surroundings. Therefore, having an audio configuration that keeps a wearers ears free to his or her surroundings may be desirable. However, when the audio configuration does not include speakers or earbuds that block a wearer's ears, the audio from the HMD may be heard by people located near the HMD. In embodiments disclosed herein, an HMD is disclosed that does not block a wearers ears, but also minimizes the audio that can be heard by people located near the HMD.

A. Example Wearable Computing Devices

Systems and devices in which example embodiments may be implemented will now be described in greater detail. In general, an example system may be implemented in or may take the form of a wearable computer (also referred to as a wearable computing device). In an example embodiment, a wearable computer takes the form of or includes a head-mountable device (HMD).

An example system may also be implemented in or take the form of other devices, such as a mobile phone, among other possibilities. Further, an example system may take the form of non-transitory computer readable medium, which has program instructions stored thereon that are executable by at a processor to provide the functionality described herein. An example system may also take the form of a device such as a wearable computer or mobile phone, or a subsystem of such a device, which includes such a non-transitory computer readable medium having such program instructions stored thereon.

An HMD may generally be any display device that is capable of being worn on the head and places a display in front of one or both eyes of the wearer. An HMD may take various forms such as a helmet or eyeglasses. As such, references to "eyeglasses" or a "glasses-style" HMD should be understood to refer to an HMD that has a glasses-like frame so that it can be worn on the head. Further, example embodiments may be implemented by or in association with an HMD with a single display or with two displays, which may be referred to as a "monocular" HMD or a "binocular" HMD, respectively.

FIG. 1A illustrates a wearable computing system according to an example embodiment. In FIG. 1A, the wearable computing system takes the form of a head-mountable device (HMD) 102 (which may also be referred to as a head-mounted display). It should be understood, however, that example systems and devices may take the form of or be implemented within or in association with other types of devices, without departing from the scope of the invention. As illustrated in FIG. 1A, the HMD 102 includes frame elements including lens-frames 104, 106 and a center frame support 108, lens elements 110, 112, and extending side-arms 114, 116. The center frame support 108 and the extending side-arms 114, 116 are configured to secure the HMD 102 to a user's face via a user's nose and ears, respectively.

Each of the frame elements 104, 106, and 108 and the extending side-arms 114, 116 may be formed of a solid structure of plastic and/or metal, or may be formed of a hollow structure of similar material so as to allow wiring and component interconnects to be internally routed through the HMD 102. Other materials may be possible as well.

One or more of each of the lens elements 110, 112 may be formed of any material that can suitably display a projected image or graphic. Each of the lens elements 110, 112 may also be sufficiently transparent to allow a user to see through the lens element. Combining these two features of the lens elements may facilitate an augmented reality or heads-up display where the projected image or graphic is superimposed over a real-world view as perceived by the user through the lens elements.

The extending side-arms 114, 116 may each be projections that extend away from the lens-frames 104, 106, respectively, and may be positioned behind a user's ears to secure the HMD 102 to the user. The extending side-arms 114, 116 may further secure the HMD 102 to the user by extending around a rear portion of the user's head. Additionally or alternatively, for example, the HMD 102 may connect to or be affixed within a head-mounted helmet structure. Other configurations for an HMD are also possible.

The HMD 102 may also include an on-board computing system 118, an image capture device 120, a sensor 122, and a finger-operable touch pad 124. The on-board computing system 118 is shown to be positioned on the extending side-arm 114 of the HMD 102; however, the on-board computing system 118 may be provided on other parts of the HMD 102 or may be positioned remote from the HMD 102 (e.g., the on-board computing system 118 could be wire- or wirelessly-connected to the HMD 102). The on-board computing system 118 may include a processor and memory, for example. The on-board computing system 118 may be configured to receive and analyze data from the image capture device 120 and the finger-operable touch pad 124 (and possibly from other sensory devices, user interfaces, or both) and generate images for output by the lens elements 110 and 112.

The image capture device 120 may be, for example, a camera that is configured to capture still images and/or to capture video. In the illustrated configuration, image capture device 120 is positioned on the extending side-arm 114 of the HMD 102; however, the image capture device 120 may be provided on other parts of the HMD 102. The image capture device 120 may be configured to capture images at various resolutions or at different frame rates. Many image capture devices with a small form-factor, such as the cameras used in mobile phones or webcams, for example, may be incorporated into an example of the HMD 102.

Further, although FIG. 1A illustrates one image capture device 120, more image capture device may be used, and each may be configured to capture the same view, or to capture different views. For example, the image capture device 120 may be forward facing to capture at least a portion of the real-world view perceived by the user. This forward facing image captured by the image capture device 120 may then be used to generate an augmented reality where computer generated images appear to interact with or overlay the real-world view perceived by the user.

The sensor 122 is shown on the extending side-arm 116 of the HMD 102; however, the sensor 122 may be positioned on other parts of the HMD 102. For illustrative purposes, only one sensor 122 is shown. However, in an example embodiment, the HMD 102 may include multiple sensors. For example, an HMD 102 may include sensors 102 such as one or more gyroscopes, one or more accelerometers, one or more magnetometers, one or more light sensors, one or more infrared sensors, and/or one or more microphones. Other sensing devices may be included in addition or in the alternative to the sensors that are specifically identified herein.

The finger-operable touch pad 124 is shown on the extending side-arm 114 of the HMD 102. However, the finger-operable touch pad 124 may be positioned on other parts of the HMD 102. Also, more than one finger-operable touch pad may be present on the HMD 102. The finger-operable touch pad 124 may be used by a user to input commands. The finger-operable touch pad 124 may sense at least one of a pressure, position and/or a movement of one or more fingers via capacitive sensing, resistance sensing, or a surface acoustic wave process, among other possibilities. The finger-operable touch pad 124 may be capable of sensing movement of one or more fingers simultaneously, in addition to sensing movement in a direction parallel or planar to the pad surface, in a direction normal to the pad surface, or both, and may also be capable of sensing a level of pressure applied to the touch pad surface. In some embodiments, the finger-operable touch pad 124 may be formed of one or more translucent or transparent insulating layers and one or more translucent or transparent conducting layers. Edges of the finger-operable touch pad 124 may be formed to have a raised, indented, or roughened surface, so as to provide tactile feedback to a user when the user's finger reaches the edge, or other area, of the finger-operable touch pad 124. If more than one finger-operable touch pad is present, each finger-operable touch pad may be operated independently, and may provide a different function.

In a further aspect, HMD 102 may be configured to receive user input in various ways, in addition or in the alternative to user input received via finger-operable touch pad 124. For example, on-board computing system 118 may implement a speech-to-text process and utilize a syntax that maps certain spoken commands to certain actions. In addition, HMD 102 may include one or more microphones via which a wearer's speech may be captured. Configured as such, HMD 102 may be operable to detect spoken commands and carry out various computing functions that correspond to the spoken commands.

As another example, HMD 102 may interpret certain head-movements as user input. For example, when HMD 102 is worn, HMD 102 may use one or more gyroscopes and/or one or more accelerometers to detect head movement. The HMD 102 may then interpret certain head-movements as being user input, such as nodding, or looking up, down, left, or right. An HMD 102 could also pan or scroll through graphics in a display according to movement. Other types of actions may also be mapped to head movement.

As yet another example, HMD 102 may interpret certain gestures (e.g., by a wearer's hand or hands) as user input. For example, HMD 102 may capture hand movements by analyzing image data from image capture device 120, and initiate actions that are defined as corresponding to certain hand movements.

As a further example, HMD 102 may interpret eye movement as user input. In particular, HMD 102 may include one or more inward-facing image capture devices and/or one or more other inward-facing sensors (not shown) that may be used to track eye movements and/or determine the direction of a wearer's gaze. As such, certain eye movements may be mapped to certain actions. For example, certain actions may be defined as corresponding to movement of the eye in a certain direction, a blink, and/or a wink, among other possibilities.

HMD 102 also includes a speaker 125 for generating audio output. In one example, the speaker could be in the form of a bone conduction speaker, also referred to as a bone conduction transducer (BCT). Speaker 125 may be, for example, a vibration transducer or an electroacoustic transducer that produces sound in response to an electrical audio signal input. The frame of HMD 102 may be designed such that when a user wears HMD 102, the speaker 125 contacts the wearer. Alternatively, speaker 125 may be embedded within the frame of HMD 102 and positioned such that, when the HMD 102 is worn, speaker 125 vibrates a portion of the frame that contacts the wearer. In either case, HMD 102 may be configured to send an audio signal to speaker 125, so that vibration of the speaker may be directly or indirectly transferred to the bone structure of the wearer. When the vibrations travel through the bone structure to the bones in the middle ear of the wearer, the wearer can interpret the vibrations provided by BCT 125 as sounds.

Various types of bone-conduction transducers (BCTs) may be implemented, depending upon the particular implementation. Generally, any component that is arranged to vibrate the HMD 102 may be incorporated as a vibration transducer. Yet further it should be understood that an HMD 102 may include a single speaker 125 or multiple speakers. In addition, the location(s) of speaker(s) on the HMD may vary, depending upon the implementation. For example, a speaker may be located proximate to a wearer's temple (as shown), behind the wearer's ear, proximate to the wearer's nose, and/or at any other location where the speaker 125 can vibrate the wearer's bone structure.

Figure 1B:
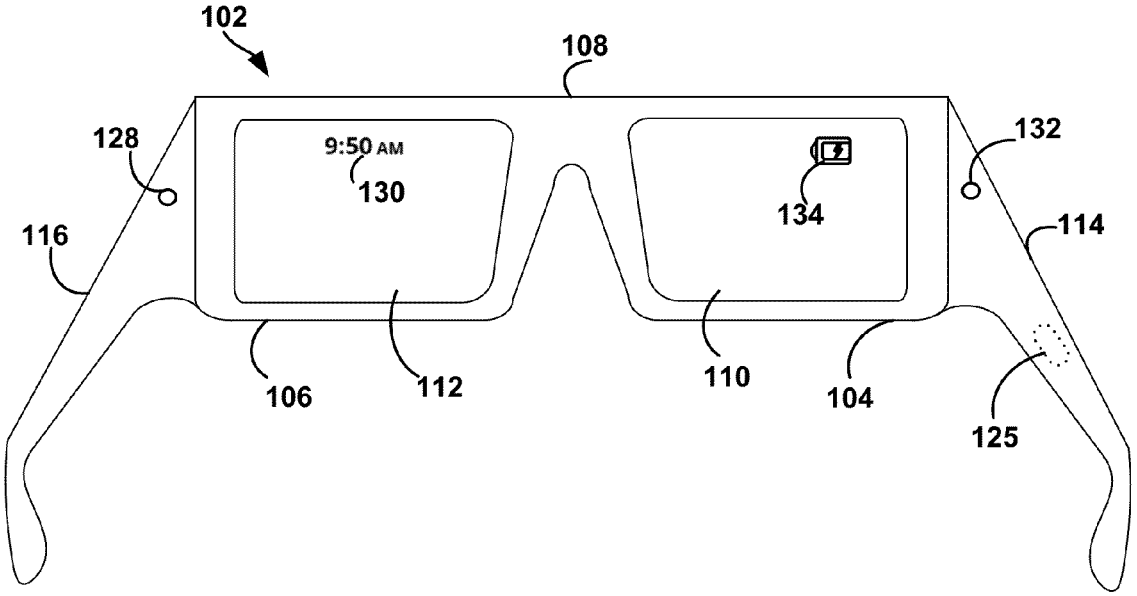
FIG. 1B illustrates an alternate view of the wearable computing device illustrated in FIG. 1A.

FIG. 1B illustrates an alternate view of the wearable computing device illustrated in FIG. 1A. As shown in FIG. 1B, the lens elements 110, 112 may act as display elements. The HMD 102 may include a first projector 128 coupled to an inside surface of the extending side-arm 116 and configured to project a display 130 onto an inside surface of the lens element 112. Additionally or alternatively, a second projector 132 may be coupled to an inside surface of the extending side-arm 114 and configured to project a display 134 onto an inside surface of the lens element 110.

The lens elements 110, 112 may act as a combiner in a light projection system and may include a coating that reflects the light projected onto them from the projectors 128, 132. In some embodiments, a reflective coating may not be used (e.g., when the projectors 128, 132 are scanning laser devices).

In alternative embodiments, other types of display elements may also be used. For example, the lens elements 110, 112 themselves may include: a transparent or semi-transparent matrix display, such as an electroluminescent display or a liquid crystal display, one or more waveguides for delivering an image to the user's eyes, or other optical elements capable of delivering an in focus near-to-eye image to the user. A corresponding display driver may be disposed within the frame elements 104, 106 for driving such a matrix display. Alternatively or additionally, a laser or LED source and scanning system could be used to draw a raster display directly onto the retina of one or more of the user's eyes. Other possibilities exist as well.

Figure 1C:
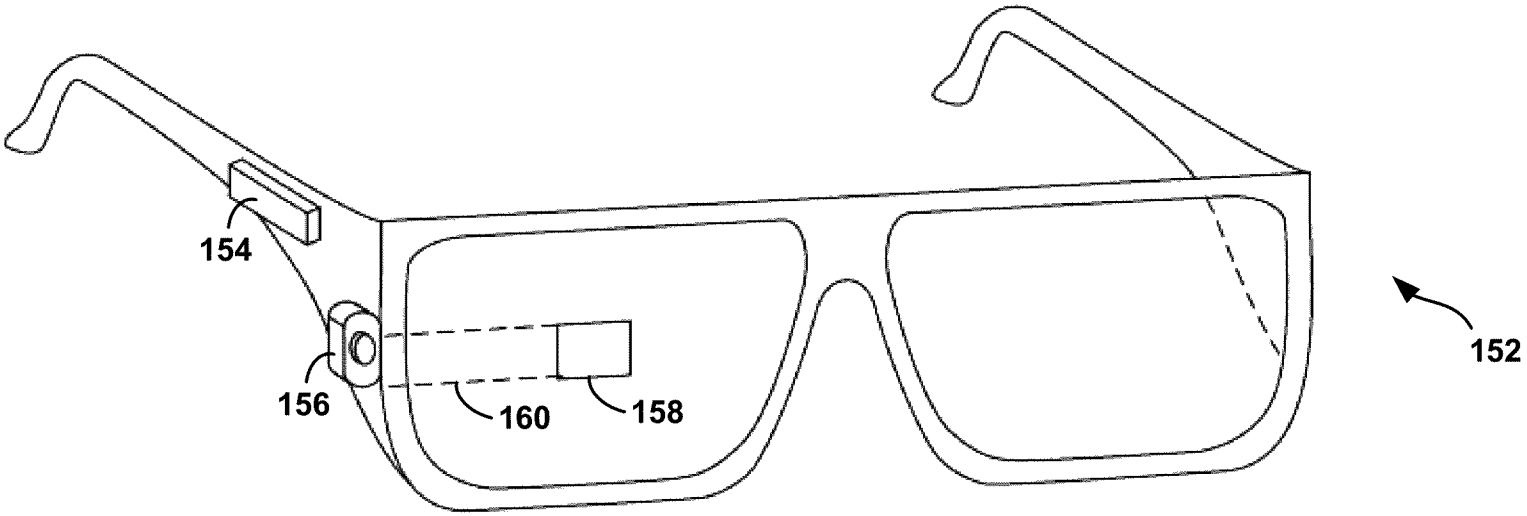
FIG. 1C illustrates another wearable computing system according to an example embodiment.

FIG. 1C illustrates another wearable computing system according to an example embodiment, which takes the form of an HMD 152. The HMD 152 may include frame elements and side-arms such as those described with respect to FIGS. 1A and 1B. The HMD 152 may additionally include an on-board computing system 154 and an image capture device 156, such as those described with respect to FIGS. 1A and 1B. The image capture device 156 is shown mounted on a frame of the HMD 152. However, the image capture device 156 may be mounted at other positions as well.

As shown in FIG. 1C, the HMD 152 may include a single display 158 which may be coupled to the device. The display 158 may be formed on one of the lens elements of the HMD 152, such as a lens element described with respect to FIGS. 1A and 1B, and may be configured to overlay computer-generated graphics in the user's view of the physical world. The display 158 is shown to be provided in a center of a lens of the HMD 152, however, the display 158 may be provided in other positions, such as for example towards either the upper or lower portions of the wearer's field of view. The display 158 is controllable via the computing system 154 that is coupled to the display 158 via an optical waveguide 160.

Figure 1D:
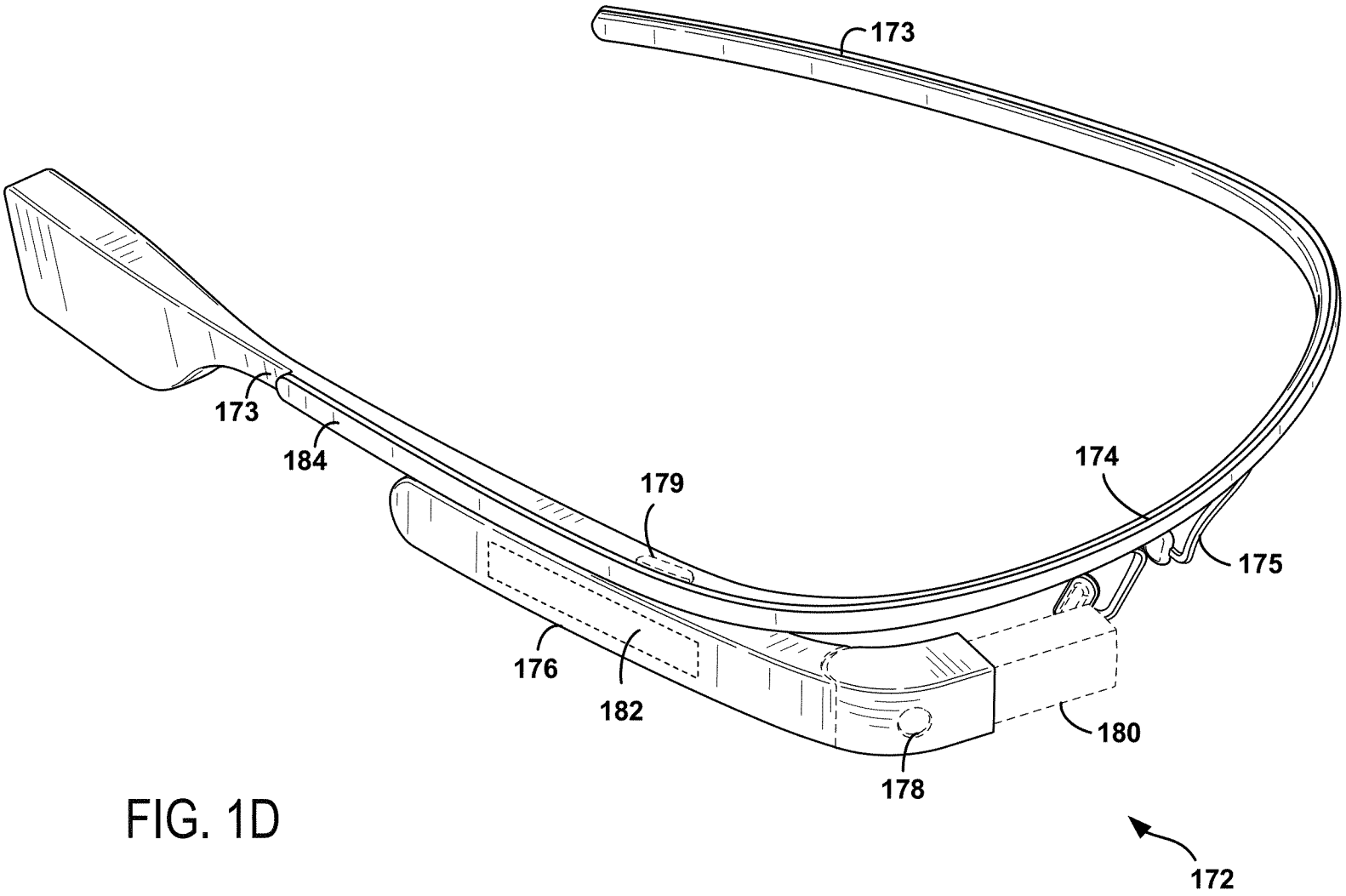
FIG. 1D illustrates another wearable computing system according to an example embodiment.

FIG. 1D illustrates another wearable computing system according to an example embodiment, which takes the form of a monocular HMD 172. The HMD 172 may include side-arms 173, a center frame support 174, and a bridge portion with nosepiece 175. In the example shown in FIG. 1D, the center frame support 174 connects the side-arms 173. The HMD 172 does not include lens-frames containing lens elements. The HMD 172 may additionally include a component housing 176, which may include an on-board computing system (not shown), an image capture device 178, and a button 179 for operating the image capture device 178 (and/or usable for other purposes). Component housing 176 may also include other electrical components and/or may be electrically connected to electrical components at other locations within or on the HMD.

The HMD 172 may include a single display 180, which may be coupled to one of the side-arms 173 via the component housing 176. In an example embodiment, the display 180 may be a see-through display, which is made of glass and/or another transparent or translucent material, such that the wearer can see their environment through the display 180. Further, the component housing 176 may include the light sources (not shown) for the display 180 and/or optical elements (not shown) to direct light from the light sources to the display 180. As such, display 180 may include optical features that direct light that is generated by such light sources towards the wearer's eye, when HMD 172 is being worn.

In a further aspect, HMD 172 may include a sliding feature 184, which may be used to adjust the length of the side-arms 173. Thus, sliding feature 184 may be used to adjust the fit of HMD 172. Further, an HMD may include other features that allow a wearer to adjust the fit of the HMD, without departing from the scope of the invention.

Figure 1E:
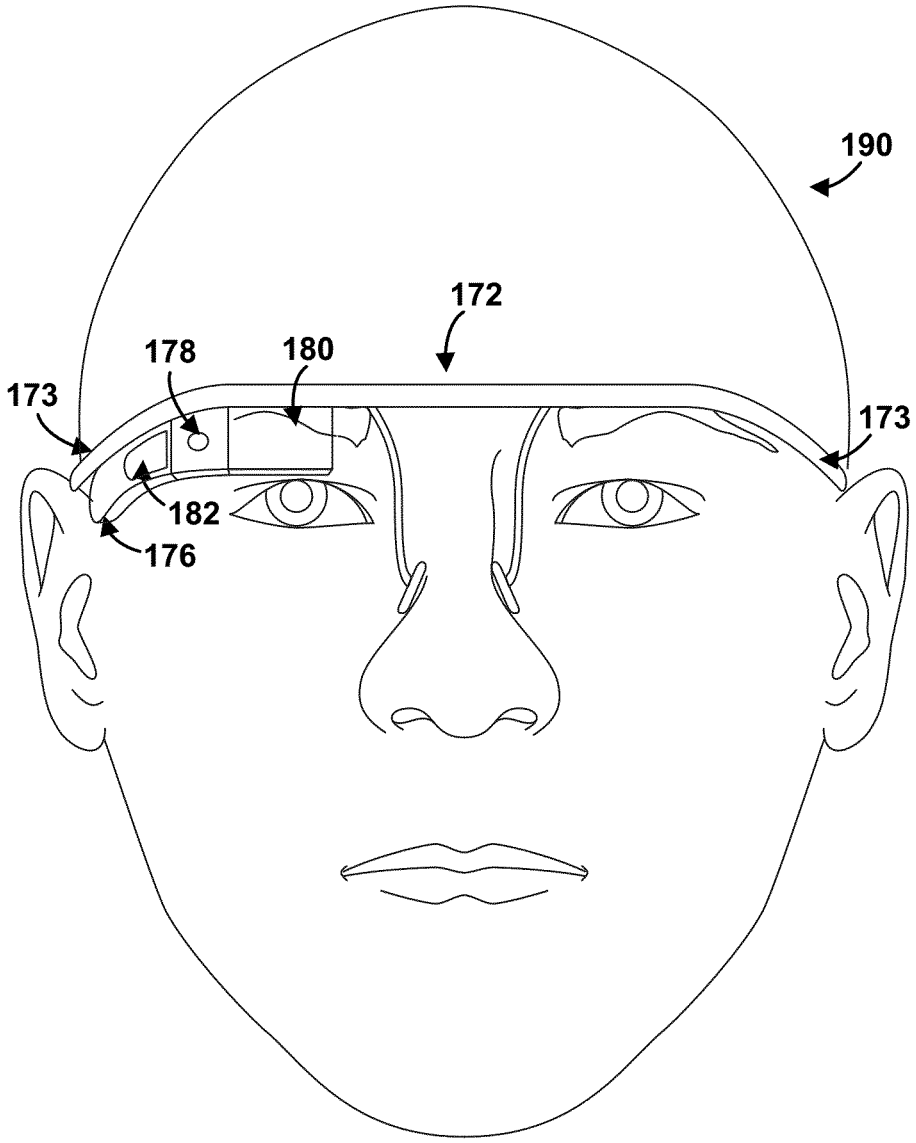
FIGS. 1E to 1G are simplified illustrations of the wearable computing system shown in FIG. 1D, being worn by a wearer.
Figure 1F:
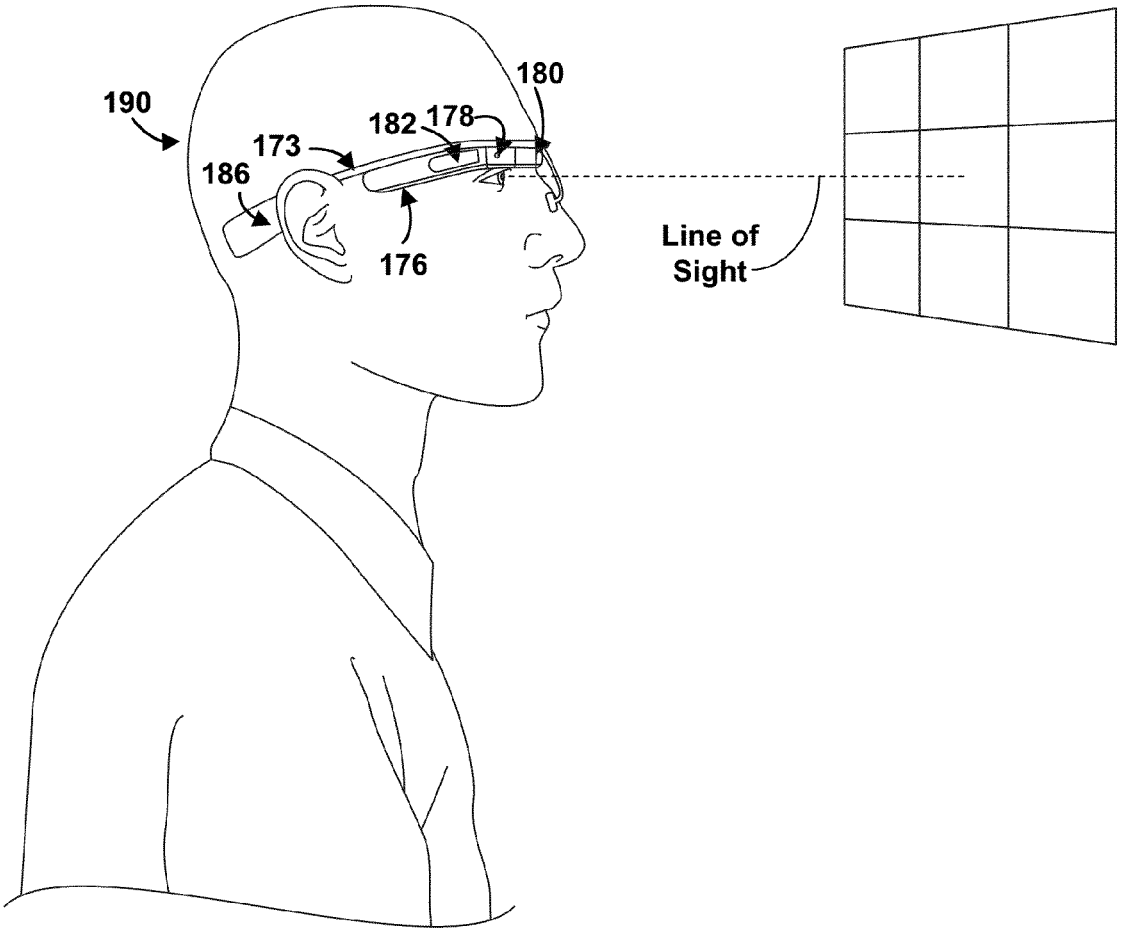
Figure 1G:
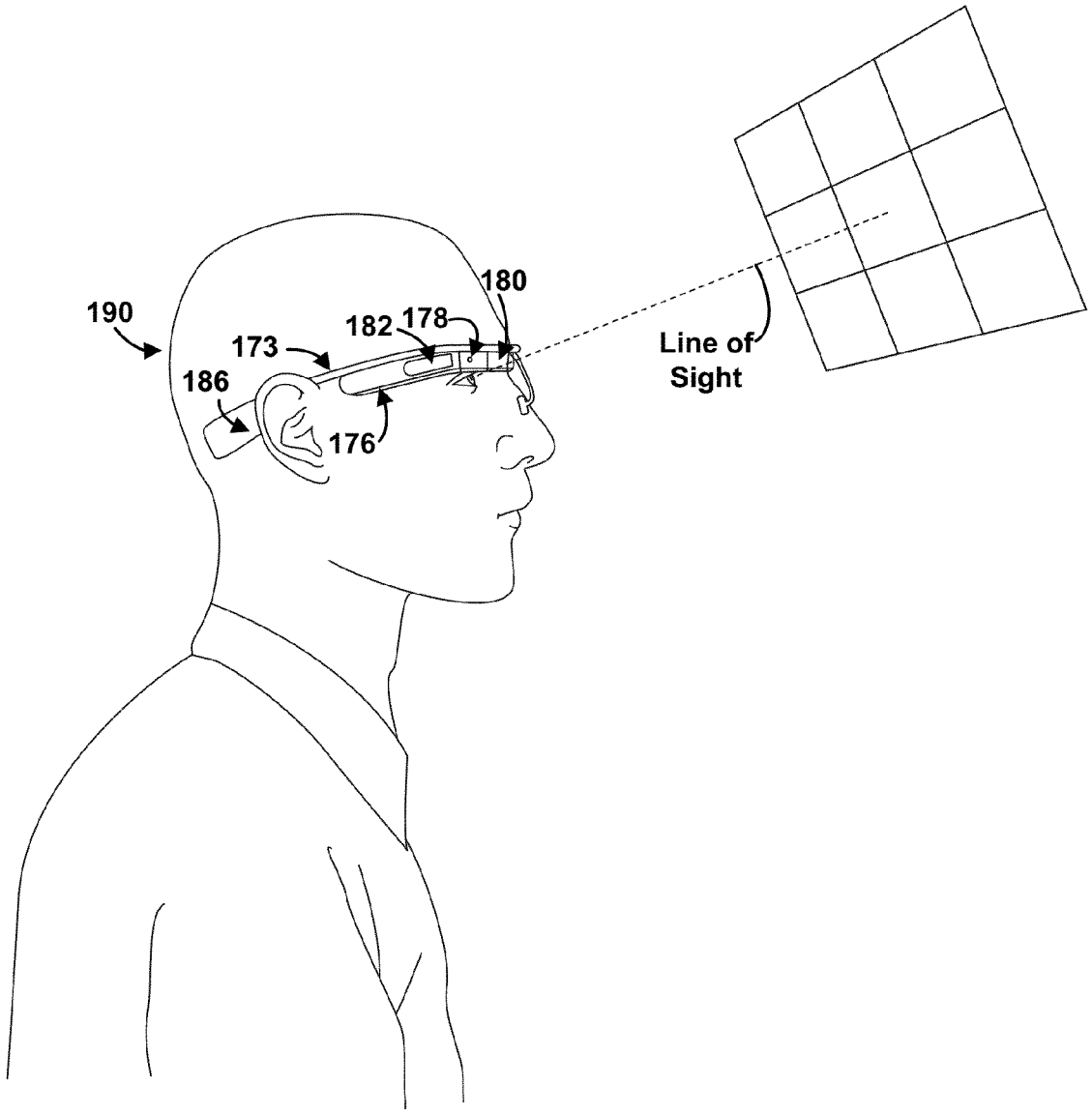

FIGS. 1E to 1G are simplified illustrations of the HMD 172 shown in FIG. 1D, being worn by a wearer 190. In the illustrated example, the display 180 may be arranged such that when HMD 172 is worn, display 180 is positioned in front of or proximate to a user's eye when the HMD 172 is worn by a user. For example, display 180 may be positioned below the center frame support and above the center of the wearer's eye, as shown in FIG. 1E. Further, in the illustrated configuration, display 180 may be offset from the center of the wearer's eye (e.g., so that the center of display 180 is positioned to the right and above of the center of the wearer's eye, from the wearer's perspective).

Configured as shown in FIGS. 1E to 1G, display 180 may be located in the periphery of the field of view of the wearer 190, when HMD 172 is worn. Thus, as shown by FIG. 1F, when the wearer 190 looks forward, the wearer 190 may see the display 180 with their peripheral vision. As a result, display 180 may be outside the central portion of the wearer's field of view when their eye is facing forward, as it commonly is for many day-to-day activities. Such positioning can facilitate unobstructed eye-to-eye conversations with others, as well as generally providing unobstructed viewing and perception of the world within the central portion of the wearer's field of view. Further, when the display 180 is located as shown, the wearer 190 may view the display 180 by, e.g., looking up with their eyes only (possibly without moving their head). This is illustrated as shown in FIG. 1G, where the wearer has moved their eyes to look up and align their line of sight with display 180. A wearer might also use the display by tilting their head down and aligning their eye with the display 180.

Figure 2:
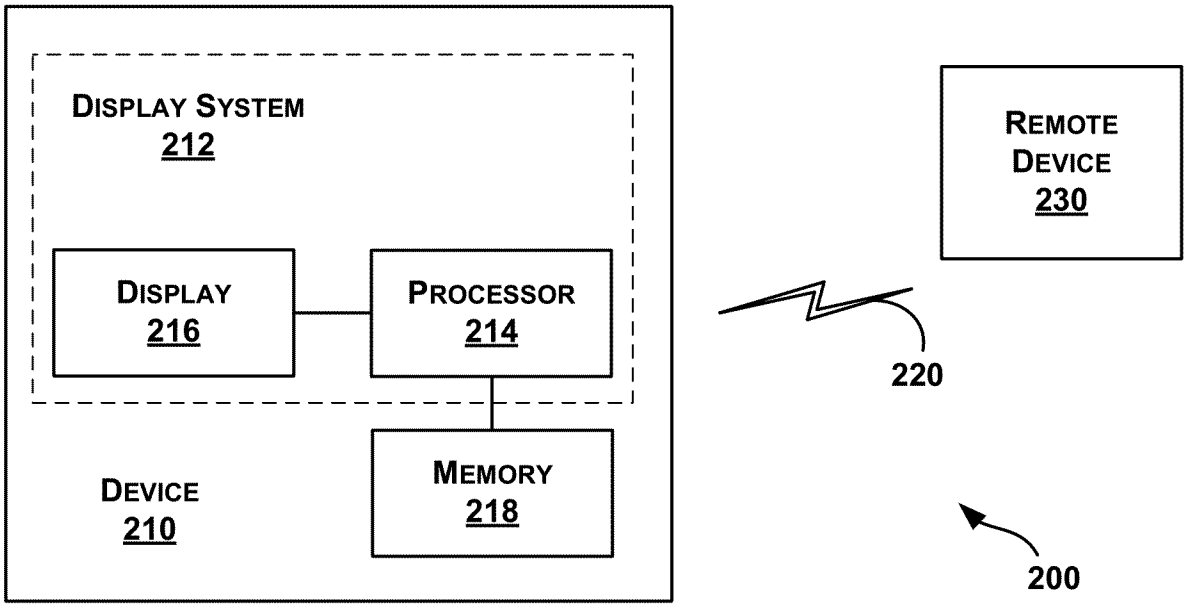
FIG. 2 is a simplified block diagram of a computing device according to an example embodiment.

FIG. 2A is a simplified block diagram a computing device 210 according to an example embodiment. In an example embodiment, device 210 communicates using a communication link 220 (e.g., a wired or wireless connection) to a remote device 230. The device 210 may be any type of device that can receive data and display information corresponding to or associated with the data. For example, the device 210 may be a heads-up display system, such as the head-mounted devices 102, 152, or 172 described with reference to FIGS. 1A to 1G.

Thus, the device 210 may include a display system 212 comprising a processor 214 and a display 216. The display 210 may be, for example, an optical see-through display, an optical see-around display, or a video see-through display. The processor 214 may receive data from the remote device 230, and configure the data for display on the display 216. The processor 214 may be any type of processor, such as a microprocessor or a digital signal processor, for example.

The device 210 may further include on-board data storage, such as memory 218 coupled to the processor 214. The memory 218 may store software that can be accessed and executed by the processor 214, for example.

The remote device 230 may be any type of computing device or transmitter including a laptop computer, a mobile telephone, or tablet computing device, etc., that is configured to transmit data to the device 210. The remote device 230 and the device 210 may contain hardware to enable the communication link 220, such as processors, transmitters, receivers, antennas, etc.

Further, remote device 230 may take the form of or be implemented in a computing system that is in communication with and configured to perform functions on behalf of client device, such as computing device 210. Such a remote device 230 may receive data from another computing device 210 (e.g., an HMD 102, 152, or 172 or a mobile phone), perform certain processing functions on behalf of the device 210, and then send the resulting data back to device 210. This functionality may be referred to as "cloud" computing.

In FIG. 2A, the communication link 220 is illustrated as a wireless connection; however, wired connections may also be used. For example, the communication link 220 may be a wired serial bus such as a universal serial bus or a parallel bus. A wired connection may be a proprietary connection as well. The communication link 220 may also be a wireless connection using, e.g., Bluetooth® radio technology, communication protocols described in IEEE 802.11 (including any IEEE 802.11 revisions), Cellular technology (such as GSM, CDMA, UMTS, EV-DO, WiMAX, or LTE), or Zigbee® technology, among other possibilities. The remote device 230 may be accessible via the Internet and may include a computing cluster associated with a particular web service (e.g., social-networking, photo sharing, address book, etc.).

B. Example Wearable Computing Device Audio Unit

Figure 3A:
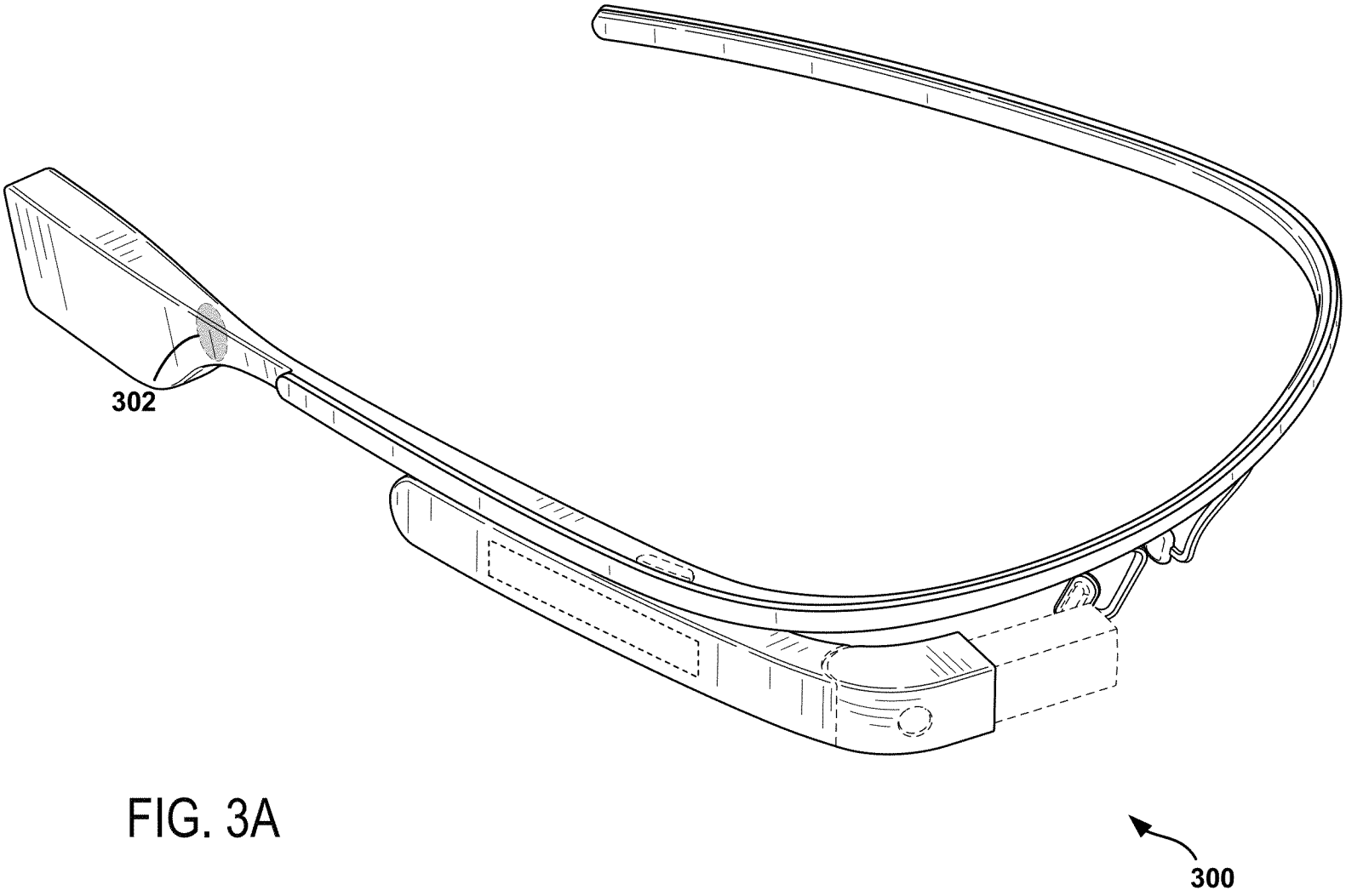
FIG. 3A illustrates a wearable computing system with an audio unit according to an example embodiment.

FIG. 3A illustrates another wearable computing system according to an example embodiment. The HMD 300 of FIG. 3A may take the form of a monocular HMD similar to HMD 172 of FIG. 1D. HMD 300 includes an audio unit 302. The audio unit 302 produces sound that can be heard by the wearer of HMD 300. However, people located near the wearer may unintentionally hear the sounds that can be heard by the wearer. Typically sounds produced by the audio unit 302 with a frequency greater than about 200 Hertz (Hz) may propagate and be heard by those near the HMD 300.

The audio unit 302 can take many forms depending on the specific embodiment. In one embodiment, audio unit 302 may be a speaker. The speaker may be configured with many different types of drivers. In some examples, the speaker driver may be a cone, a balanced armature, or a static driver. In another embodiment, the audio unit 302 may feature more than one driver. One driver may be located on the inside of HMD 300 and the other may be located on the outside of HMD 300.

The audio unit 302 may be located in close proximity to the ear (or ear canal) of the wearer of HMD 300. In some embodiments, the audio unit 302 is configured to not block the ear canal of the wearer. Thus, the wearer can hear sounds both produced by the audio unit 302 as well as ambient sounds from the wearer's environment. Additionally, the audio 302 may transmit audio signals that may be heard by those in close proximity to HMD 300.

The audio unit 302 may be configured to transmit audio as an acoustic dipole. An acoustic dipole transmits audio in-phase in one direction and out-of-phase in the opposite direction. The sound transmitted in-phase may be transmitted close to the ear (or ear canal) of the wearer of HMD 300. By transmitting the sound close the ear, the wearer may be able to hear the sound from the audio unit 302. The sound played in-phase may be substantially similar to the sound played out-of-phase. Thus, in the far field, the in-phase and out-of-phase signal deconstructively interfere. The deconstructive interference may cause the sound heard by a person who is not wearing HMD 300 to be very quiet (or possibly not heard at all).

In some embodiments, the audio unit 302 may be configured to operate in two modes. The first mode is the acoustic dipole mode as previous described. In the second mode, the audio unit 302 may transmit audio in-phase in both directions. Thus, the first mode of operation may be considered a privacy mode that is intended to only be heard by the wearer of the HMD 300. The second mode may be a public mode where the audio is intended to be heard by both the wearer of the HMD 300 as well as those around the wearer. Additionally, the second mode may include the HMD 300 not being worn at all. The HMD 300 may provide audio without being worn on the head at all.

In some embodiments, a wearer of the HMD 300 may control the mode of operation of the audio. However, in another embodiment, a processor in the HMD 300 may control the mode of operation of the audio. For example, the HMD 300 may sense that it is not currently being worn. Thus, it may switch to a mode where all audio will be played in a way that people near the HMD 300 will hear it. Alternatively, the HMD 300 may sense that it is currently being worn. When HMD 300 determines it is being worn, it may switch to a mode designed to prevent people near the HMD 300 from hearing audio. Further, when HMD 300 determines it is being worn, it make may a determination based on the type of audio and/or a user input to select the mode of operation. For example, a wearer of HMD 300 may be listening to a song with HMD 300. If the user wants to listen in private, a mode may be selected to prevent others from hearing. However, if the user wants others to be able to hear as well, a mode may be selected to allow the audio to be heard by those located near HMD 300.

Figure 3B:
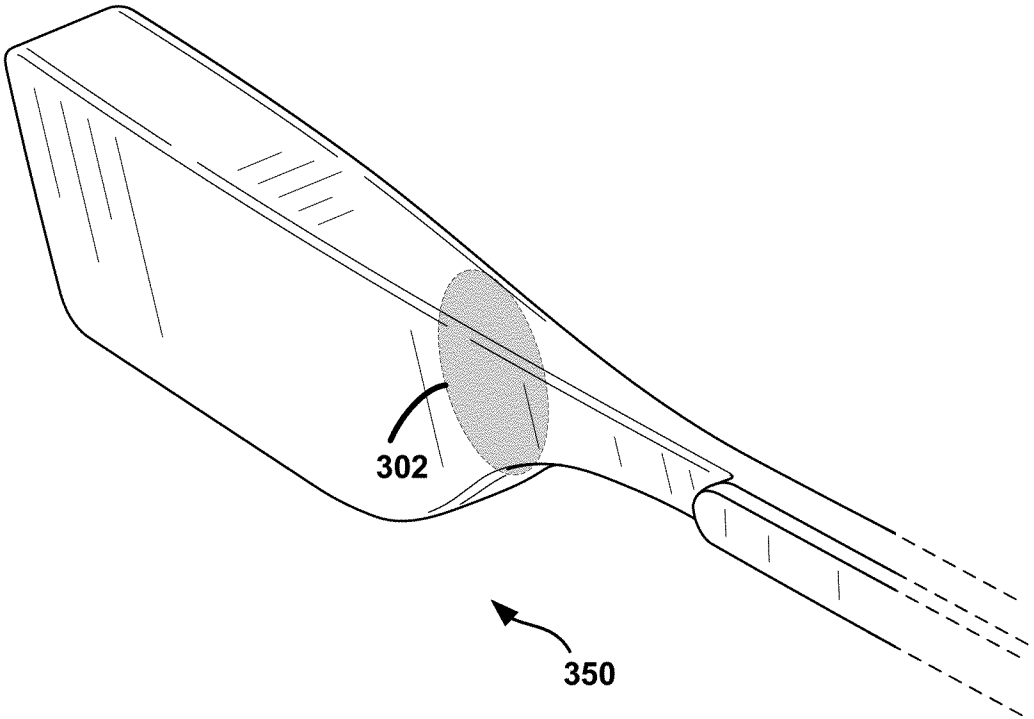
FIG. 3B illustrates an audio unit according to an example embodiment.

FIG. 3B illustrates the a larger example of the side 350 of HMD 300. The side 350 includes audio unit 302. Although the audio unit is shown at a specific location along the stem of the HMD 300, the location of the audio unit 302 may be moved based up on the specific embodiment. Additionally, the audio unit 302 may contain more or fewer components than what is shown in FIG. 3B.

Figure 3C:
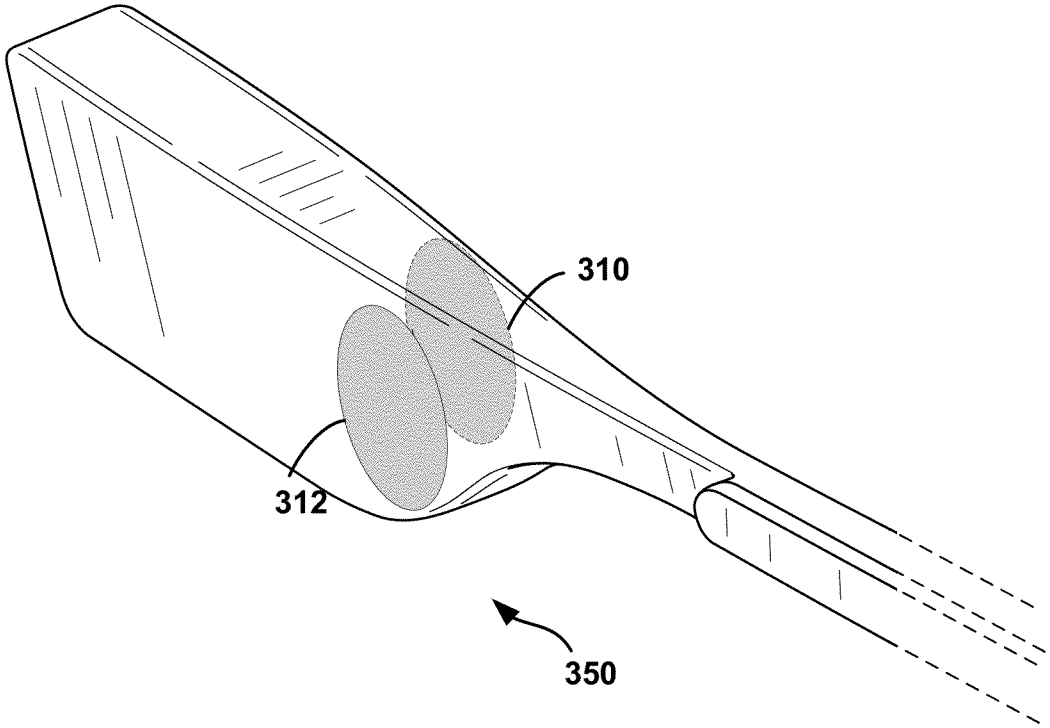
FIG. 3C illustrates an audio unit according to an example embodiment.

FIG. 3C illustrates one example audio unit configuration on the side 350 of HMD 300 (of FIG. 3A). The audio unit of FIG. 3C has two audio drivers. The first audio driver 310 faces inward toward the wearer of the HMD 300. The second audio driver 312 faces outward away from the wearer of the HMD 300. In some examples, the each driver may be a cone, a balanced armature, or a static driver. The positions of the first audio driver 310 and the second audio driver 312 as shown in FIG. 3C is one example of the positioning. Each audio driver may be moved to different locations on HMD 300.

In one mode of operation the first audio driver 310 and the second audio driver 312 may play the same sound but with a 180 degree phase shift. The phase shift will cause deconstructive interference far away from HMD 300. However, the wearer of HMD 300 will still be able to hear the audio due to the relatively close proximity of the first audio driver 310 to the wearer's ear.

Figure 3D:
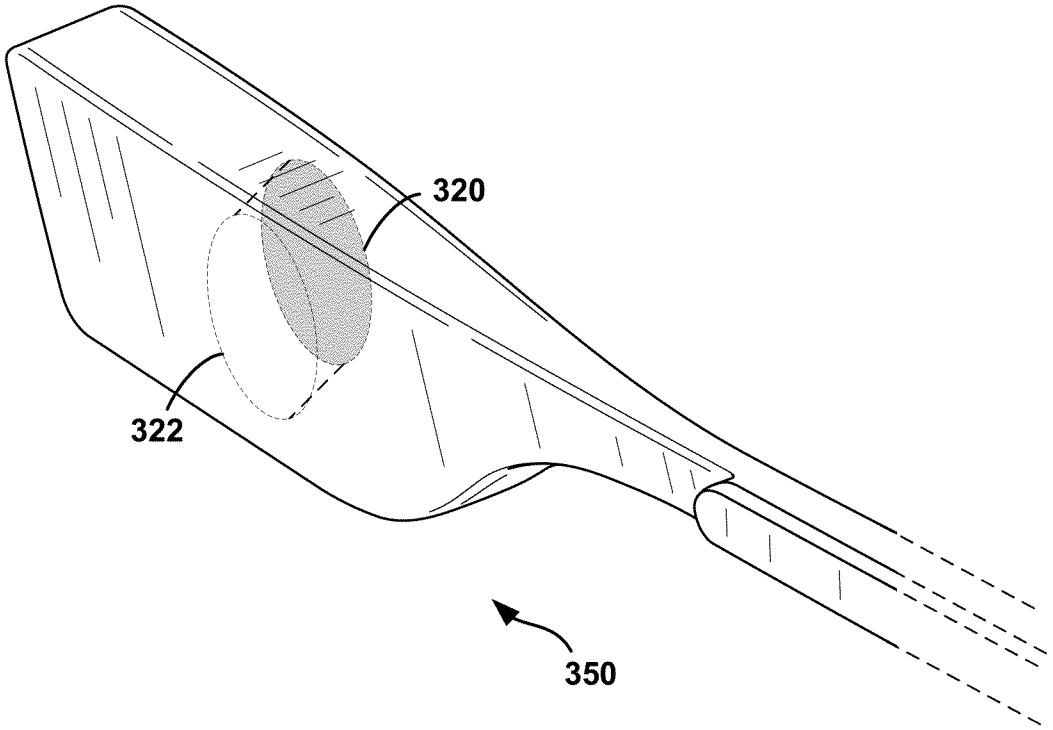
FIG. 3D illustrates an audio unit according to an example embodiment.

FIG. 3D illustrates another example audio unit configuration on the side 350 of HMD 300 (of FIG. 3A). The audio unit of FIG. 3C has a single audio driver 320 and an audio port 322. In one embodiment, as shown in FIG. 3D, the audio driver 320 faces inward toward the wearer of the HMD 300 and the audio port 322 couples from the side of the driver that does not face the wearer through side 350 of HMD 300. In a second embodiment (not shown), the audio driver 320 may be mounted within the side 350 of HMD 300. The audio port 322 may couple one side of the audio driver 320 inward toward the wearer of the HMD 300 and the audio port 322 may couple the other side of the audio driver 320 from the rear of the driver through side 350 of HMD 300. In the second embodiment, the audio port 322 may be a tube through the side 350, with the audio driver 320 mounted at some point in the tube. In a third embodiment (not shown), the audio driver 320 faces outward away from the wearer of the HMD 300 and the audio port 322 couples from the side of the driver that faces the wearer through side 350 of HMD 300. In some examples, the each driver may be a cone, a balanced armature, or a static driver. The positions of the audio driver 320 and the audio port 322 as shown in FIG. 3D is one example of the positioning. The audio driver 320 and audio port 322 may be moved to different locations on HMD 300 depending on the specific embodiment.

In one mode of operation, the audio driver 320 vibrates to transmit audio to a wearer of the HMD 300. While transmitting audio to the wearer, the audio drive 320 may also transmit a second signal in the opposite direction. For example, if the audio driver 320 has a cone driver, audio is transmitted from both the front and back surface of the cone. However, the audio from the front of the cone is 180 degrees out of phase with the audio from the back of the cone. The audio port 322 may conduct the audio from the back of the driver 320 to the environment external to HMD 300. Far away from HMD 300 (i.e. a few feet), the phase shift will cause deconstructive interference far away from HMD 300. However, the wearer of HMD 300 will still be able to hear the audio due to the relatively close proximity of the audio driver 320 to the wearer's ear.

C. Conclusion

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. An apparatus comprising:

a support structure comprising a front section and at least one side section; and at least one audio unit mounted on the side section, wherein the audio unit is configured to operate in a first mode, wherein the first mode comprises the audio unit being configured to conduct an in-phase signal and an out-of-phase audio signal, wherein one of the in-phase signal and the out-of-phase signal is directed toward an ear of the wearer of the apparatus, and wherein the in-phase signal and the out-of-phase audio signal deconstructively interfere in the far field.

2. The apparatus of claim 1, wherein the audio unit forms an acoustic dipole.

3. The apparatus of claim 1, wherein the in-phase signal and the out-of-phase signal have a 180 degree phase difference.

4. The apparatus of claim 1, wherein the audio unit is further configured to operate in a second mode, wherein the second mode comprises the audio unit being configured to conduct two in-phase signals, wherein one of the in-phase signals is directed toward an ear of the wearer of the apparatus, and wherein the two in-phase signals constructively interfere in the far field.

5. The apparatus of claim 1, wherein the audio unit comprises one audio driver.

6. The apparatus of claim 1, wherein the audio unit comprises two audio drivers.

7. The apparatus of claim 1, wherein, the audio unit comprises a driver, wherein the driver is selected from the group consisting of a cone audio driver, a static audio driver, and a balanced armature audio driver.

8. The apparatus of claim 1, wherein the audio unit is arranged on the support structure such that then the device is worn, the unit is proximate to an ear, such that sound from the unit is audible at the ear.

9. The apparatus of claim 8, wherein the audio unit is located in a position on the support structure between the ear and the front section.

10. The apparatus of claim 8, wherein the audio unit is located in a position on the support structure that is not between the ear and the front section.

11. A method of operating an audio unit in one of two modes comprising:

operating a first mode, where operating in the first mode comprises:

conducting a first audio signal directed in a first direction with a first phase; and conducting a second audio signal in a second direction with a second phase, wherein the first and second direction are different directions and wherein one of the first direction and the second direction is the direction of a wearer's ear; and operating a second mode, where operating in the second mode comprises:

conducting the first audio signal directed in a first direction with the first phase; and conducting the second audio signal in a second direction with the first phase, wherein the first and second direction are different directions.

12. The method of claim 11, wherein the first phase and the second phase have a 180 degree phase difference.

13. The method of claim 11, wherein both the first audio signal and the second audio signal are provided by one audio driver.

14. The method of claim 11, wherein the first audio signal is provided by a first audio driver and the second audio signal is provided by a second audio driver.

15. An article of manufacture including a non-transitory computer-readable medium having stored thereon program instructions that, if executed by a processor in a head-worn device, cause the head-worn device to perform operations comprising:

operating a first mode, where operating in the first mode comprises:

conducting a first audio signal directed in a first direction with a first phase; and conducting a second audio signal in a second direction with a second phase, wherein the first and second direction are different directions and wherein one of the first direction and the second direction is the direction of a wearer's ear; and operating a second mode, where operating in the second mode comprises:

conducting the first audio signal directed in a first direction with the first phase; and conducting the second audio signal in a second direction with the first phase, wherein the first and second direction are different directions.

16. The article of manufacture of claim 15, wherein the first phase and the second phase have a 180 degree phase difference.

17. The article of manufacture of claim 15, wherein both the first audio signal and the second audio signal are provided by one audio driver.

18. The article of manufacture of claim 15, wherein the first audio signal is provided by a first audio driver and the second audio signal is provided by a second audio driver.

19. The article of manufacture of claim 15, further comprising program instructions for determining in which of two modes to operate the head-worn device and responsive to the determination, switch to the determined mode.

* * * * *